US005365211A

United States Patent [19]

Carbaugh, Jr. et al.

[11] Patent Number: 5,365,211

[45] Date of Patent: Nov. 15, 1994

[54] WOUND COIL WITH INTEGRAL COOLING PASSAGES

[75] Inventors: William D. Carbaugh, Jr., Marlboro; David C. Long, Wappingers Falls, both of N.Y.; Karl F. Stroms, Las Vegas, Nev.

[73] Assignee: International Business Machines Corporation, Armonk, N.Y.

[21] Appl. No.: 996,765

[22] Filed: Dec. 18, 1992

[51] Int. Cl.[5] ..... H01F 5/00

[52] U.S. Cl. ..... 335/300; 336/60; 83/171

[58] Field of Search ..... 335/216, 282, 299, 300; 336/55, 57, 58, 59, 60, 61, 62, 206, 223; 310/52–65; 83/169–171, 575–577

[56] References Cited

U.S. PATENT DOCUMENTS

| | | | |
|---|---|---|---|
| 4,209,129 | 6/1980 | Haas et al. | 234/108 |
| 4,821,614 | 4/1989 | Fleet et al. | 83/100 |
| 4,872,381 | 10/1989 | Stroms | 83/76.1 |

OTHER PUBLICATIONS

IBM Technical Disclosure Bulletin, vol. 33, No. 4, Sep. 1990, "Coil Design For Magnetic Repulsion Punch", pp. 219–220, J. A. Frankeny & R. F. Frankeny.

*Primary Examiner*—Leo P. Picard
*Assistant Examiner*—Ramon M. Barrera
*Attorney, Agent, or Firm*—Whitham, Curtis, Whitham & McGinn

[57] ABSTRACT

A magneto repulsion electrical tape wound coil has been developed with improved current distribution and improved heat transfer. The coil is easy and is expensive to manufacture and simple to mount. The coil comprises a conductive strip (e.g., a copper strip) with rectangular openings stamped in it with a standard metal stamp. The single row of openings are at regular intervals and arranged so that the width of the openings and the spacing of the openings is such that when the coil is wound there is an overlap of the openings, forming radial passages extending from the outer periphery of the coil to its central core electrode. Cooling fluid may be supplied from a hollow inner electrode so that the cooling fluid flows radially, outwardly. Since the openings overlap to form radial passages, a cross-flow path for the cooling fluid may be established where fluid enters the passages on one side of the coil and exits from the other side of the coil.

27 Claims, 5 Drawing Sheets

WOUND COIL WITH INTEGRAL COOLING PASSAGES

BACKGROUND OF THE INVENTION

1. Field of the Invention

This invention relates to improvements in wound coils with integral cooling passages, and more particularly in magnetic repulsion drive coil for a flex punch to a drive coil with improved current distribution and improved heat transfer characteristics.

2. Description of the Prior Art

The invention is disclosed herein with reference to its specific preferred embodiment of a tape wound coil for a flex punch. However, as also disclosed and claimed, the basic technology has additional applications.

Flex punches, using a magnetic repulsion drive coil are described in U.S. Pat. Nos. 4,872,381 and 4,821,614, assigned to the assignee of this application and incorporated herein by reference.

A drive coil for a magnetic repulsion flex punch is described in IBM Information Disclosure Bulletin Vol. 33, No. 4, September 1990.

As will be appreciated by those skilled in the art, magnetic repulsion flex punch technology is used to punch via openings in so-called green sheets used in making multi-layer ceramic substrates. As described in greater detail in the aforereferenced IBM Technical Disclosure Bulletin, a drive coil for such magnetic repulsion punches can be advantageously made from a thin copper strip wound into a tight spiral around a central conductive rod. A thin insulating coating covers one surface of the copper strip and the strip is wound with the uninsulated surface outwardly facing. Another conductive post is attached to the coil at its outer peripheral surface.

While generally satisfactory, the rate at which heat can be removed from prior art magnetic repulsion drive coils is limited and, this in turn, limits the frequency at which the punch can operate.

SUMMARY OF THE INVENTION

An object of this invention is the provision of a magnetic repulsive drive coil for a flex punch with improved current distribution through the coil, and improved heat transfer channels as compared with prior art designs.

Another object of this invention is a coil that is relatively inexpensive to manufacture and provides a simple mounting and cooling system.

Briefly, this invention contemplates the provision of a magnetic repulsive drive coil in which openings are stamped in a conductive strip (e.g., a copper strip) by means of a standard metal stamping operation. The openings are preferably spaced at regular intervals and arranged so that the width of the openings relative to the spacing of the openings is such that, when the coil is wound, the openings overlap, forming connected passages extending from the outer periphery of the coil to its central core electrode. Cooling fluid, such as water, may be supplied from a hollow inner electrode so that the cooling fluid flows radially, outwardly. Since the openings overlap to form connected passages, a cross-flow path for the cooling fluid can be established where fluid enters the passages on one side of the coil and exits from the other side of the coil.

The openings are punched in the upper half of the strip so that, in operation of the coil, current flow is concentrated in the lower half of the coil adjacent to the disk to maintain high magnetic efficiency.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
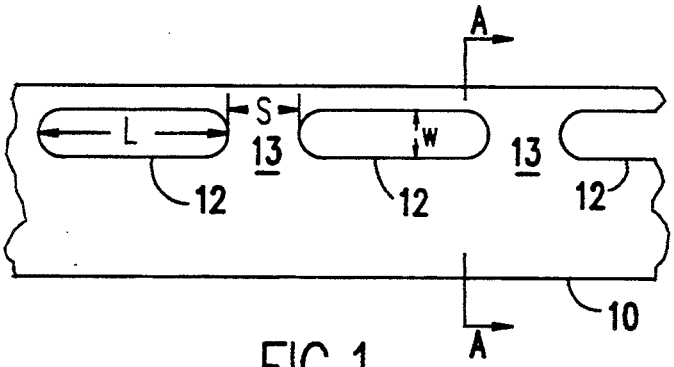
FIG. 1 is a fragmentary view of a copper strip with holes punched therein and from which a drive coil is wound in accordance with the teachings of this invention.
Figure 2A:
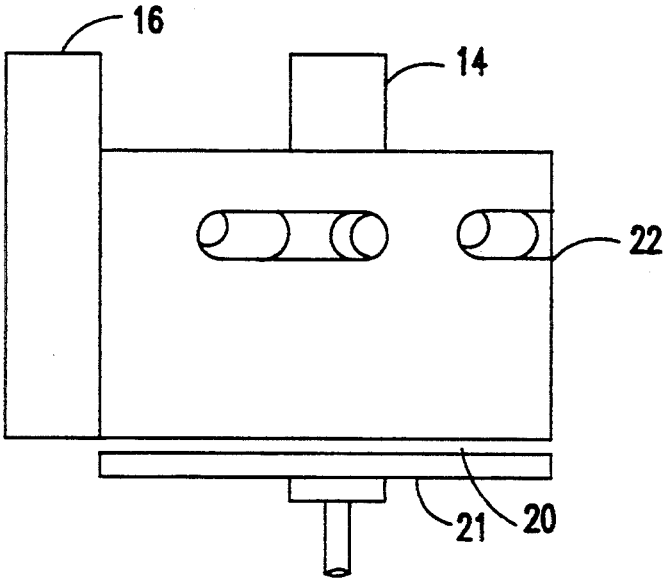
FIGS. 2A and 2B are respectively a side elevation and a top view of a coil assembled from the strip shown in FIG. 1.

Referring now to FIGS. 1 and 2, a copper strip 10 on the order of 0.002 inches thick and about 0.5 inches wide has a series of rectangular openings 12 punched in it adjacent to one of its edges. The width (W) of each opening is on the order of 20% of the width of the strip, and the length (L) of each opening is about three times as long as the space (S) between openings.

Figure 2B:
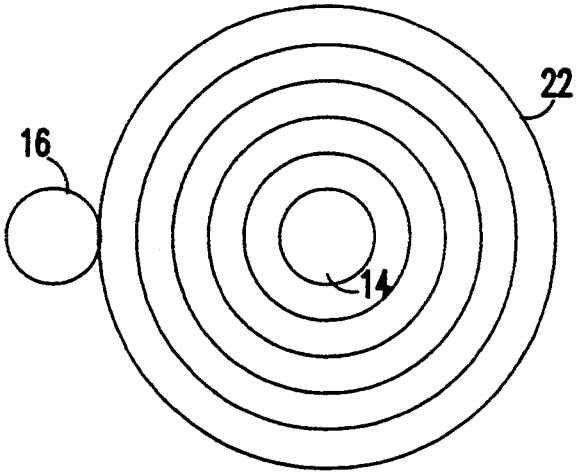

There is a thin insulating coating 11 on both surfaces of the strip 10. The insulating coating preferably has a high thermal conductivity to enhance the heat transfer. A ceramic or glass material with a high thermal conductivity is suitable. A coil with glass or glass ceramic insulating coating can be sintered to form an extremely rigid structure. Preferably a protective coating is applied to the stamped edges of the openings to prevent corrosion or electrolysis of the strip. In forming the coil, copper rod 14 is welded to the strip 10 at one end of the strip so that the rod is mechanically and electrically connected to the strip. The strip is then coated with a thin layer of adhesive and tightly wound around the rod 14. There are about thirty complete turns in a typical coil 22. A second copper rod 16 is welded to the end of the strip 10 after it has been completely wound. Alternately, the insulating coating on the strip can be a partially cured adhesive which is brought to a final cure at heating the coil after winding. The rods 14 and 16 provide electrical connection to the coil. The bottom surface 20 of the completed coil along the edge where there are no holes, is placed next to a copper disk 21 which is repelled by magneto repulsion action. It will be appreciated that the view in FIG. 2B is only representative; actually, the coil is wound in a continuous spiral with adjacent layers in contact with one another.

It should be noted that the openings 12 in succeeding layers of the coil overlap after the coil has been wound, and the spaces (S) between openings in one layer cannot block the passages in adjacent layers. These overlapping openings provide a number of connected passages through the coil through which a cooling fluid, such as water, can pass providing improved heat transfer. These connected passages serve to increase the surface area of the copper strip that is exposed to the flowing coolant. This increased surface area is much greater than the surface area that would be provided by simply drilling holes or machining slots into a finished coil made from an unperforated strip.

Figure 3:
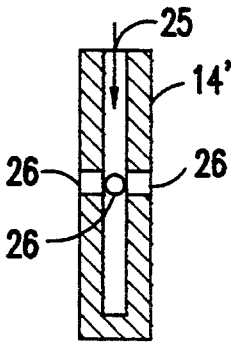
FIG. 3 is a sectional view of a central conductor to implement one alternative embodiment of the invention.

Referring now to FIG. 3, in this embodiment, the center rod 14' has a central passage 25 (closed at its bottom) with openings 26 through which a cooling fluid can be injected into the passages formed by the overlapping holes 12, and flows outwardly to cool the coil.

Figure 4A:
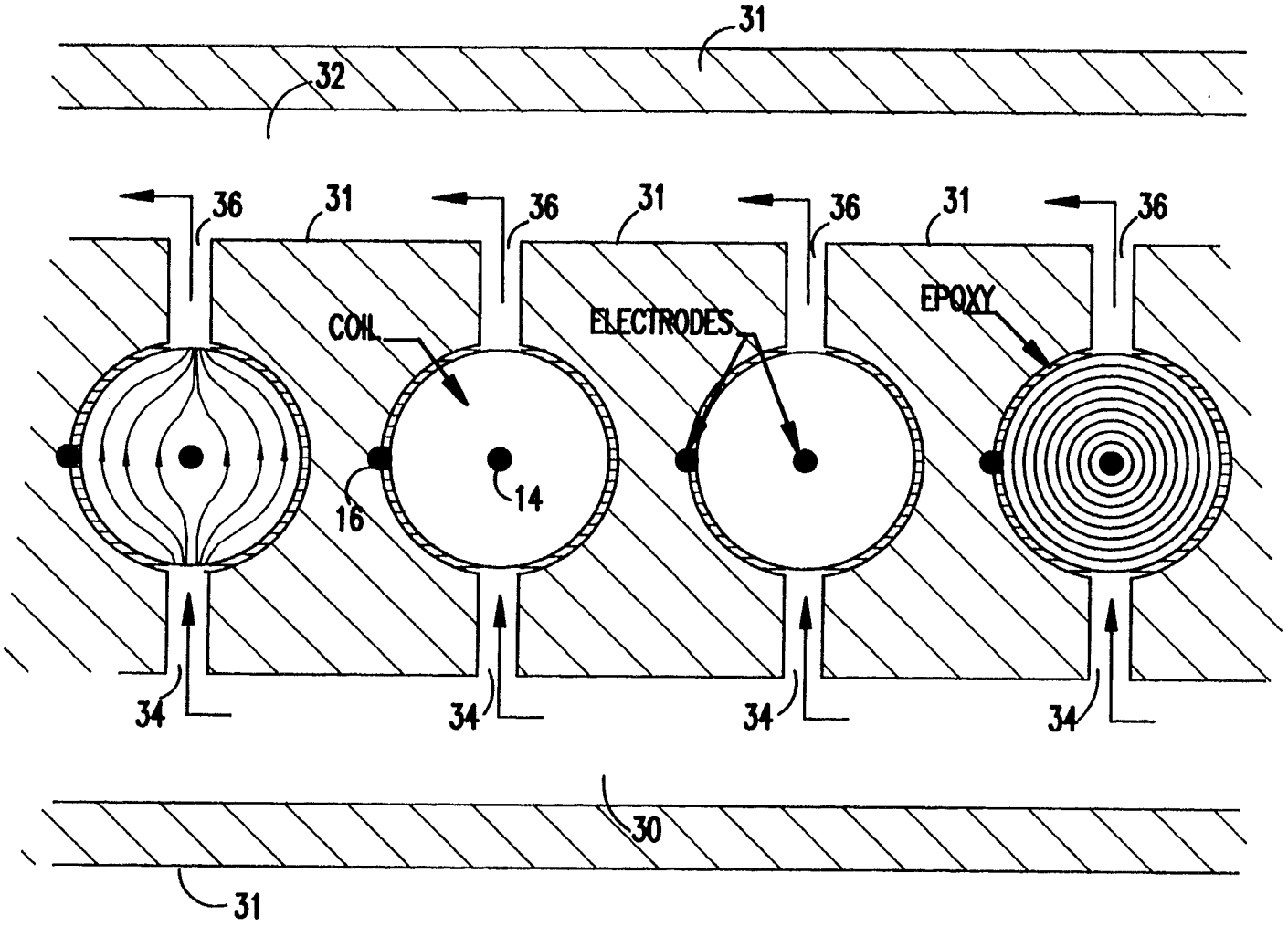
FIG. 4A is a schematic diagram of a cross-feed cooling system for coils in accordance with the teachings of the invention.
Figure 4B:
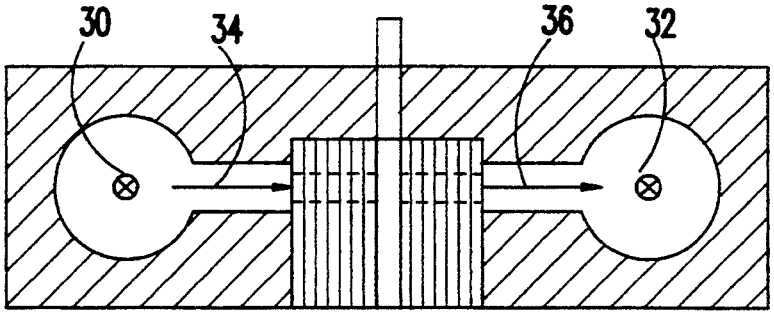
FIG. 4B is a sectional view of the cross-feed cooling system.

FIG. 4A and sectional view 4B show four coils mounted in a housing 31 made from plastic or an insulating material with a common coolant fluid supply header 30 and a common coolant return header 32. The coils 22 are glued in place in the housing 31 using a suitable epoxy. The housing contains entrance channels 34 and exit channels 36 that direct the cooling fluid through the passages formed by the overlapping openings 12, in a direction across the coil, as indicated by the arrows in the left-hand coil in FIG. 4.

Figure 5:
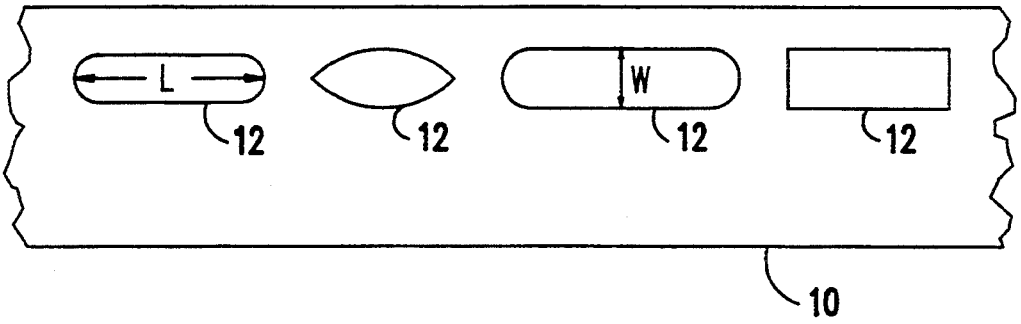
FIGS. 5, 6, 7, 8, 9A, 9B and 9C are schematic views of alternate embodiments of the invention.

FIG. 5 illustrates yet another embodiment of the invention. Here, the opening 12 in the strip 10 are of varying lengths, widths and shapes.

Figure 6:
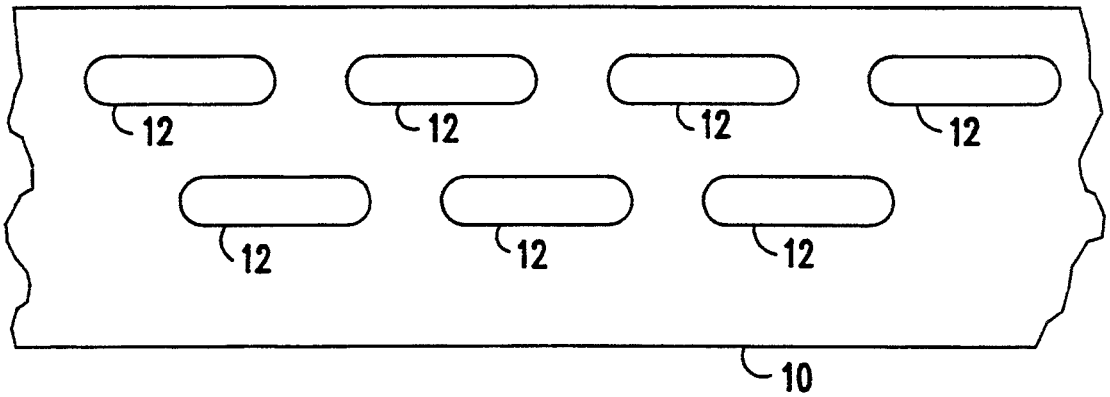

In the embodiment of FIG. 6, the openings 12 are punched in more than a single row.

Figure 7:
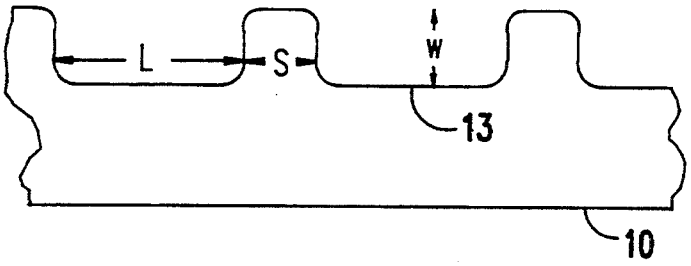

Referring to FIG. 7, another embodiment consists of punching openings 13 along the upper edge of the strip 10. The openings 13 break through the upper edge so that, before winding, the strip has a series of notches rather than holes, along its upper edge. Alternately, the finished coil of FIG. 2A can have its upper surface machined off, exposing the openings.

Figure 8:
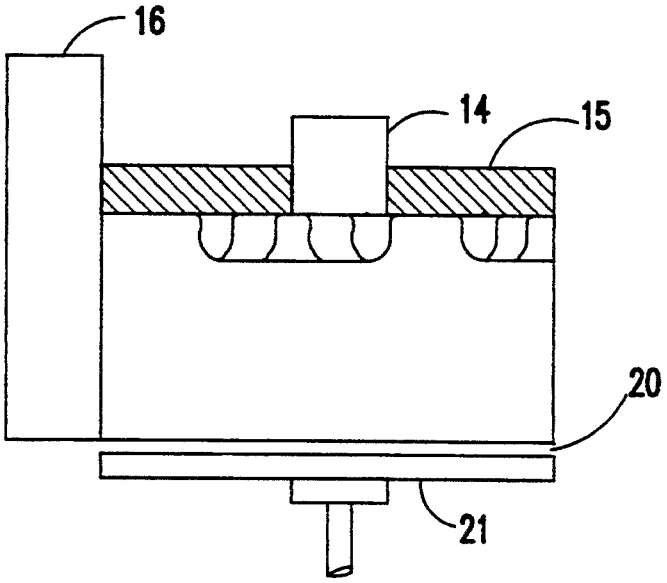

Referring to FIG. 8, these embodiments (i.e., FIG. 7 or modified FIG. 2) would require a suitable nonconductive cap or washer 15 to contain the coolant within the connected passages. The benefit of these alternative embodiments is improved current distribution in the strip because all the magnetizing current is conducted below the cooling passages, resulting in improved magnetic performance.

Figure 1A:
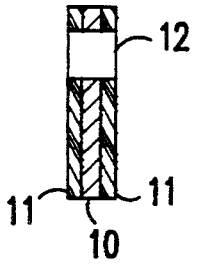
FIG. 1A is a sectional view along A—A of FIG. 1.
Figure 9A:
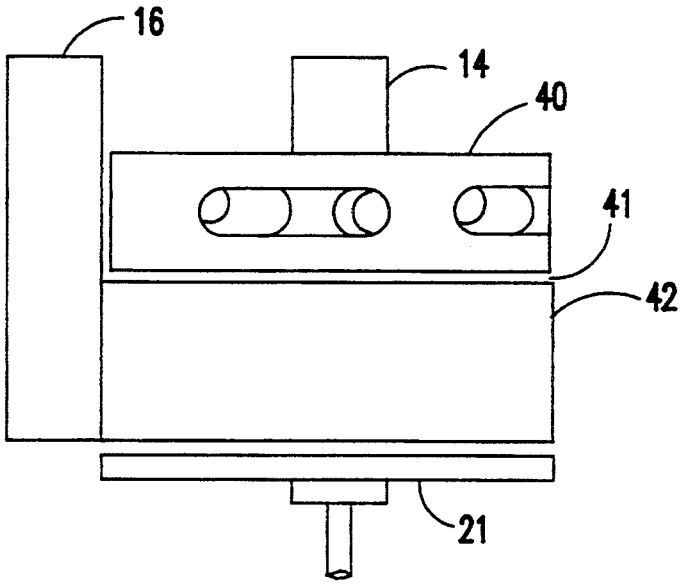
Figure 9B:
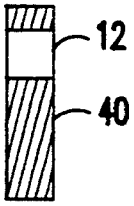
Figure 9C:
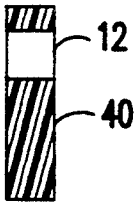

Alternately, referring to FIG. 9A, in a magnetic repulsion flex punch the drive coil function and the cooling function can be separated by cooling a conventional electrical tape wound drive coil 42 with a perforated tape wound drive coil 40 thermally contacting the coil 42 at an interface 41. The cooling coil could be constructed of perforated metallic strip, with an insulating coating as shown in FIG. 1A or without an insulating coating as shown in FIG. 9B. Alternatively, the coil 40 could be formed of an electrically insulating material with good thermal conductivity such as a ceramic material, e.g., Barillia (BeO), as illustrated in FIG. 9C. Further, it will be appreciated that a coil such as that represented by FIG. 9C can be sintered after having been wound in order to form a rigid thermal conductive structure.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. An electromagnetic coil comprising:

a thin electrically conductive sheet with a series of openings formed in said sheet, said series of openings extending along the length of said thin electrically conductive sheet with adjacent openings separated by a web of said conductive sheet material;

said thin electrically conductive sheet having an insulating coating on at least one surface; and said thin electrically conductive sheet being wrapped in a spiral to form said coil with said openings in adjacent layers partially overlapping in the direction of said length of said conductive sheet to form at least one fluid passageway having increased surface area of said thin electrically conductive sheet forming a surface of said at least one passageway and extending throughout said coil allowing passage of thermally conductive fluid through said coil.

2. A coil as in claim 1, wherein said openings are concentrated along one longitudinal edge of said thin electrically conductive sheet.

3. A coil as in claim 1, wherein said openings are arranged in more than one row.

4. A coil as in claim 1, wherein said coil is wrapped about a central conductive member which has a central fluid passage and radially extending fluid ports providing a flow channel between said central extending throughout said coil.

5. A coil as in claim 1, wherein said openings vary in size and spacing along said strip.

6. A coil as in claim 1, wherein said openings vary in shape and spacing along said strip.

7. A coil as in claim 1, wherein said openings vary in shape and size along said strip.

8. A coil as in claim 1, further including a baffle surrounding said coil forming a fluid flow supply passage on one side of said coil and a fluid flow return passage on another side of said coil, and a fluid supply header connected to said fluid flow supply passage and a fluid return header connected to said fluid flow return passage.

9. A coil as in claim 8, wherein there are a plurality of said coils in proximity to one another each surrounded by a baffle and coupled to a common supply header and a common return header.

10. A coil as in claim 1, wherein said coil is a rigid assembly created by bonding each layer of said winding to its adjacent layers.

11. A coil as in claim 1, wherein a protective coating is applied to edges of said punched openings to prevent corrosion and electrolysis of said conductive strip.

12. A coil as in claim 1, wherein said insulated coatings are of high thermal conductivity to increase heat transfer.

13. A coil as in claim 1, wherein the openings break through an edge of the thin electrically conductive sheet creating a series of notches along said edge.

14. A coil as in claim 13, wherein a nonconductive cap is placed in contact with said edge to contain a flow of coolant.

15. A coil as in claim 1, with a central electrode connected to one end of said thin electrically conductive sheet and an outer electrode connected to the other end of said thin electrically conductive sheet.

16. A coil as in claim 15, wherein said coil is disposed adjacent a magnetic repulsion drive punch.

17. A coil as in claim 1, including a second insulated, electrically conductive sheet wrapped in a spiral in thermal contact with said thin electrically conductive sheet having a series of openings.

18. A coil as in claim 1, wherein said insulating coatings are of a high thermal conductivity ceramic.

19. A coil as in claim 1, wherein said insulating coatings are of a high thermal conductivity glass ceramic material.

20. A coil as in claim 18, wherein said coil is sintered to form a rigid structure.

21. A coil as in claim 19, wherein said coil is sintered to form a rigid structure.

22. A coil as in claim 1, wherein said coil is used to provide heat transfer to another device.

23. An electromagnetic coil comprising:

a conductive sheet with a series of openings punched in said sheet, said series of openings extending along the length of said conductive sheet with adjacent opening separated by a web of said conductive sheet material; and said conductive sheet wrapped in a spiral to form said coil with said openings in adjacent layers partially overlapping in a direction of said length of said conductive sheet to form at least one fluid passageway having increased surface area of said conductive sheet forming a surface of said at least one passageway and extending throughout said coil allowing passage of thermally conductive fluid through said coil.

24. A coil as in claim 23, wherein said coil is constructed of an electrically conductive sheet.

25. A coil as in claim 23, wherein said coil is constructed of an electrically insulating material.

26. A coil as in claim 23, wherein said coil is constructed of a thermally conductive ceramic material and is sintered to form a rigid structure.

27. A coil as in claim 23, wherein said coil is mounted adjacent a magneto repulsion drive coil in order to dissipate heat from said drive coil.

* * * * *